US011508229B1

(12) United States Patent
Byrd

(10) Patent No.: US 11,508,229 B1
(45) Date of Patent: Nov. 22, 2022

(54) WIRELESS BABY MONITOR ASSEMBLY

(71) Applicant: Krystal Byrd, Salem, OR (US)

(72) Inventor: Krystal Byrd, Salem, OR (US)

( * ) Notice: Subject to any disclaimer, the term of this patent is extended or adjusted under 35 U.S.C. 154(b) by 0 days.

(21) Appl. No.: 17/400,628

(22) Filed: Aug. 12, 2021

(51) Int. Cl.
*G08B 21/02* (2006.01)
*G08B 25/10* (2006.01)
*H04R 1/10* (2006.01)

(52) U.S. Cl.
CPC ..... *G08B 21/0208* (2013.01); *G08B 25/10* (2013.01); *H04R 1/1016* (2013.01); *H04R 1/1025* (2013.01); *H04R 2420/07* (2013.01)

(58) Field of Classification Search
CPC .. G08B 21/0208; G08B 25/10; H04R 1/1016; H04R 1/1025; H04R 2420/07; H04M 1/6058; H04M 1/6066
See application file for complete search history.

(56) References Cited

U.S. PATENT DOCUMENTS

| | | | | |
|---|---|---|---|---|
| 7,696,888 | B2 | 4/2010 | Swan | |
| 7,697,891 | B2 | 4/2010 | Desrosiers | |
| 9,191,744 | B2 | 11/2015 | Anderson | |
| 9,402,120 | B2 | 7/2016 | Linden | |
| 9,591,419 | B2 | 3/2017 | Getter | |
| D786,221 | S | 5/2017 | Stoch | |
| 10,425,717 | B2 | 9/2019 | Angel, Jr. | |
| 2003/0083540 | A1* | 5/2003 | Fitzgerald | G08B 21/0208 600/27 |
| 2004/0157555 | A1* | 8/2004 | Richenstein | H04R 5/04 455/39 |
| 2004/0257233 | A1* | 12/2004 | Proebsting | G08B 23/00 340/539.1 |
| 2006/0083393 | A1* | 4/2006 | Richenstein | H04R 5/04 381/302 |
| 2006/0287745 | A1* | 12/2006 | Richenstein | H04S 3/004 700/94 |
| 2021/0314691 | A1* | 10/2021 | Campbell | G10K 11/17885 |
| 2021/0314692 | A1* | 10/2021 | Campbell | H04R 5/033 |

* cited by examiner

*Primary Examiner* — Orlando Bousono

(57) ABSTRACT

A wireless baby monitor assembly includes a personal electronic device which receives a media signal from an extrinsic communication network. A baby monitor is positionable in a room where a baby is sleeping to capture the sounds of the baby crying. The baby monitor broadcasts an alert signal when the baby monitor captures the sounds of the baby crying. A pair of ear buds is each insertable into a respective one of a user's ears for emitting audible sounds into the user's ears. Each of the ear buds is in wireless communication with the personal electronic device to stream music for the user to listen to. Additionally, each of the ear buds is in wireless communication with the baby monitor. Each of the ear buds reduces a volume of the audio signal when the ear buds receives an alert signal from the baby monitor to alert the user that the baby is crying.

7 Claims, 4 Drawing Sheets

WIRELESS BABY MONITOR ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to baby monitor devices and more particularly pertains to a new baby monitor device for monitoring a baby through ear buds. The device includes a baby monitor and a pair of ear buds that are in wireless communication with the baby monitor. Additionally, the ear buds are in wireless communication with a personal electronic device for streaming audio from the personal electronic device. The ear buds reduce the volume of the streaming audio when the baby monitor transmits the sound of the baby crying to the ear buds. In this way a caregiver can hear the baby crying while the user is listening to music.

(2) Description of Related Art Including Information Disclosed Under 37 CFR 1.97 and 1.98

The prior art relates to baby monitor devices including a headphone device that monitors ambient noise levels and alerts a user to the presence of ambient noise that exceeds a broadcast signal to the headphones. The prior art discloses a baby monitor device that includes a video signal that is broadcast to a smart device. The prior art discloses a variety of headphone devices that inject ambient noises into a broadcast signal that is received by a pair of headphones. The prior art discloses a wireless ear bud device for wirelessly broadcasting audio to a pair of ear buds. The prior art discloses a wireless baby monitor device that includes a broadcast unit that is positioned near a baby and a receiver unit that is positioned near a caregiver.

BRIEF SUMMARY OF THE INVENTION

An embodiment of the disclosure meets the needs presented above by generally comprising a personal electronic device which receives a media signal from an extrinsic communication network. A baby monitor is positionable in a room where a baby is sleeping to capture the sounds of the baby crying. The baby monitor broadcasts an alert signal when the baby monitor captures the sounds of the baby crying. A pair of ear buds is each insertable into a respective one of a user's ears for emitting audible sounds into the user's ears. Each of the ear buds is in wireless communication with the personal electronic device to stream music for the user to listen to. Additionally, each of the ear buds is in wireless communication with the baby monitor. Each of the ear buds reduces a volume of the audio signal when the ear buds receives an alert signal from the baby monitor to alert the user that the baby is crying.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
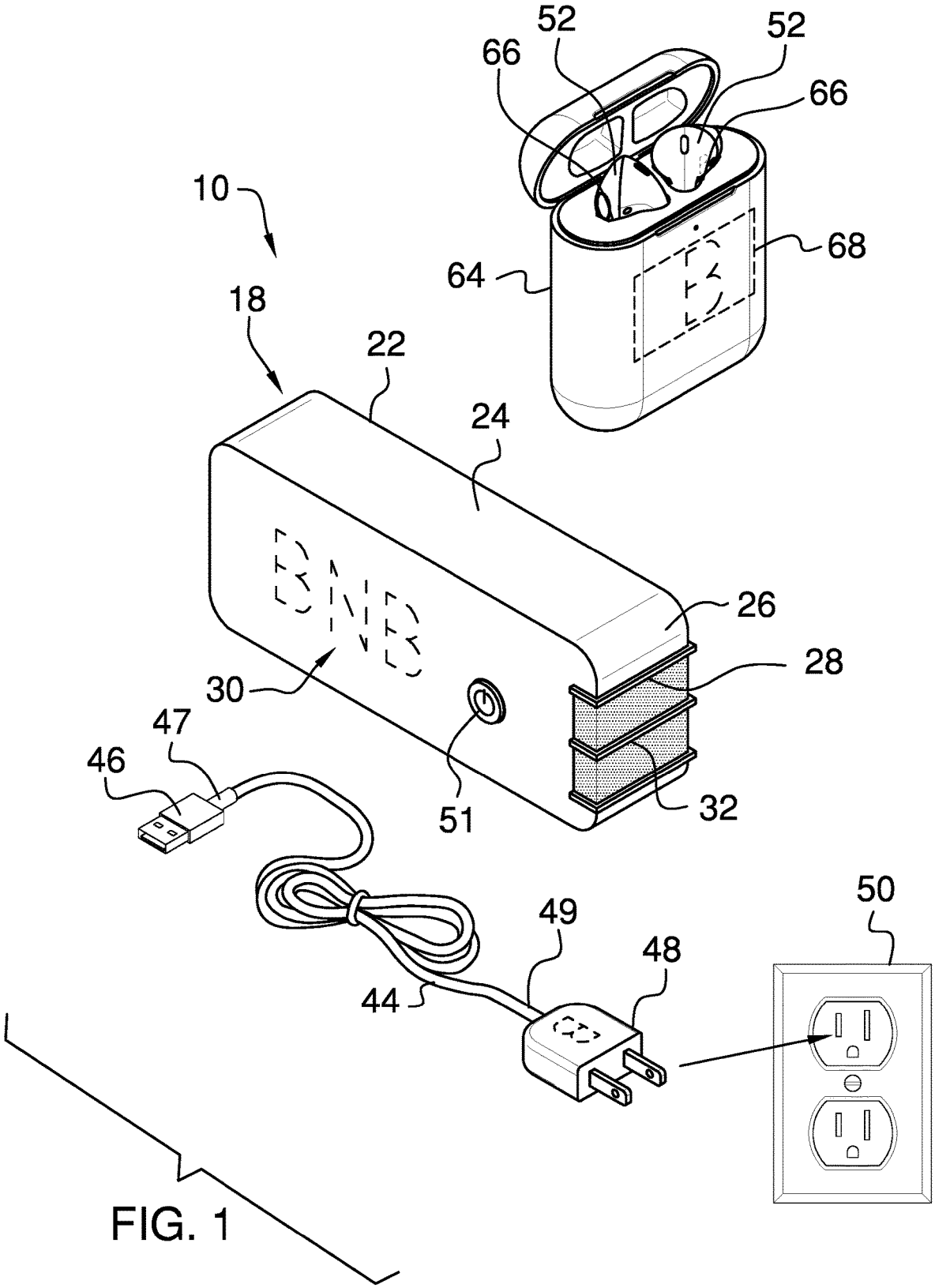
FIG. 1 is a perspective view of a wireless baby monitor assembly according to an embodiment of the disclosure.
Figure 2:
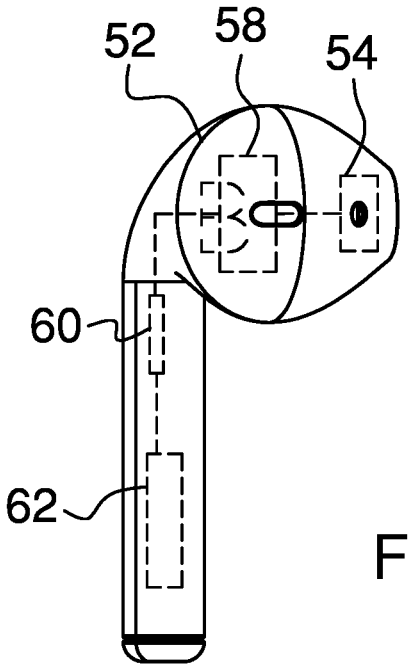
FIG. 2 is a perspective view of an ear bud of an embodiment of the disclosure.
Figure 3:
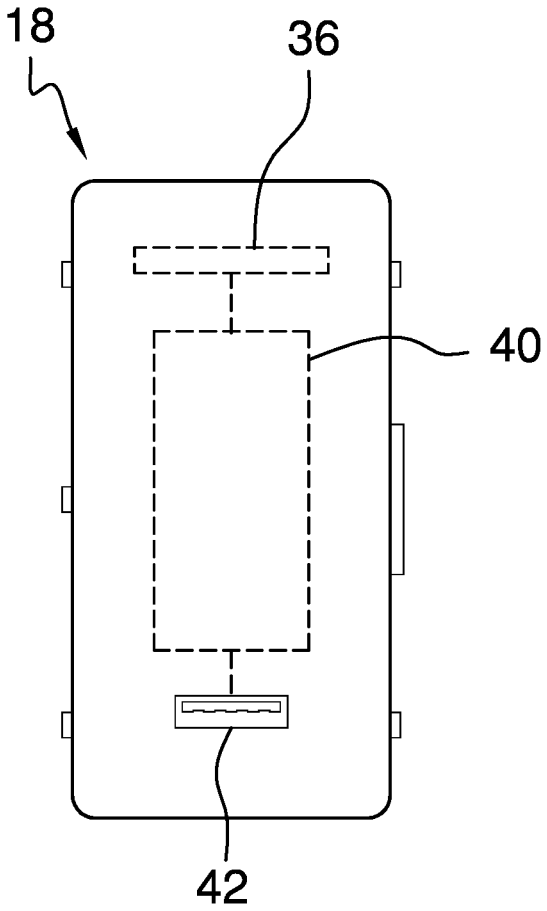
FIG. 3 is a bottom phantom view of baby monitor of an embodiment of the disclosure.
Figure 4:
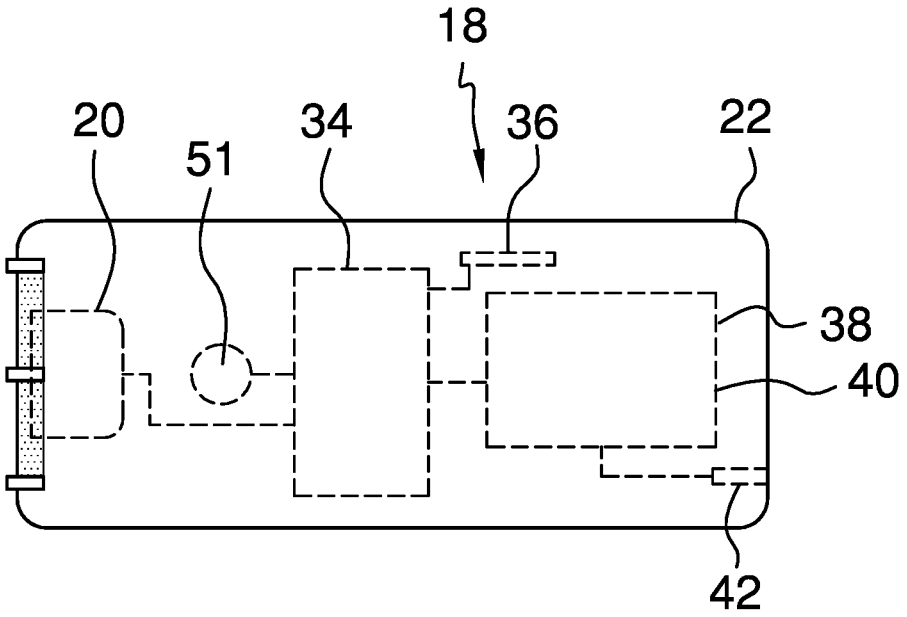
FIG. 4 is a top phantom view of baby monitor of an embodiment of the disclosure.
Figure 5:
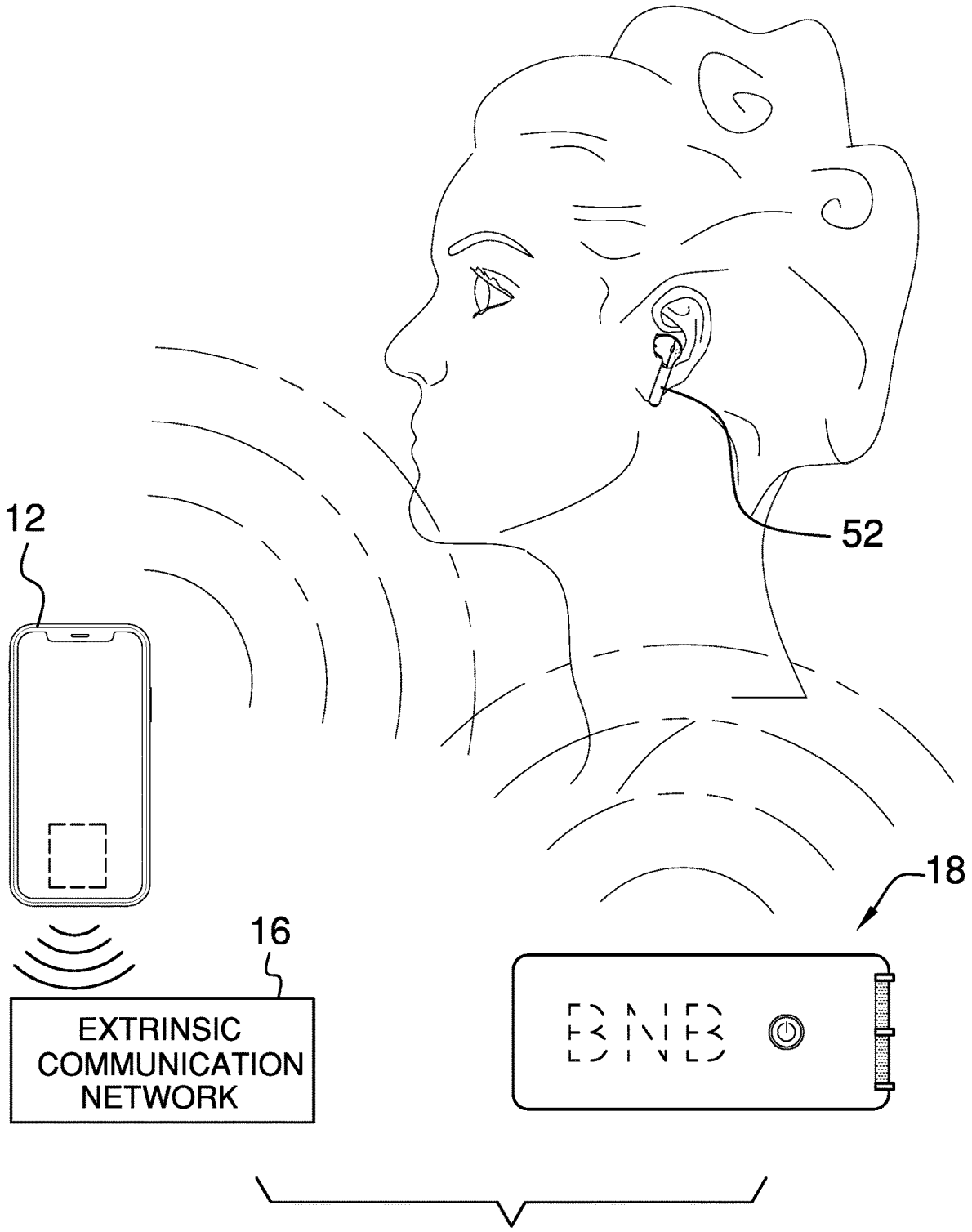
FIG. 5 is a perspective view of an embodiment of the disclosure.

With reference now to the drawings, and in particular to FIGS. 1 through 5 thereof, a new baby monitor device embodying the principles and concepts of an embodiment of the disclosure and generally designated by the reference numeral 10 will be described.

As best illustrated in FIGS. 1 through 5, the wireless baby monitor assembly 10 generally comprises a personal electronic device 12 that includes a device transceiver 14 which is in wireless communication with an extrinsic communication network 16. Moreover, the personal electronic device 12 receives a media signal from the extrinsic communication network 16. The personal electronic device 12 may be a smart phone or the like and the extrinsic communication network 16 may be a cellular phone network, the internet or other type of wireless communication network.

A baby monitor 18 is provided and the baby monitor 18 is positionable in a room where a baby is sleeping. The baby monitor 18 has a microphone 20 that is integrated into the baby monitor 18 to capture the sounds of the baby crying.

The baby monitor 18 broadcasts an alert signal when the microphone 20 captures the sounds of the baby crying. The baby monitor 18 comprises a housing 22 that has an outer wall 24 and the outer wall 24 has a first lateral side 26.

The first lateral side 26 has a sound opening 28 extending into an interior of the housing 22 to pass audible sounds into the housing 22. Additionally, the microphone 20 is integrated into the housing 22 and the microphone 20 is aligned with the sound opening 28. The outer wall 24 has indicia 30 printed thereon and the indicia 30 may comprise the letters "BNB". The microphone 20 may be an electronic microphone or the like. A screen 32 is coupled to the outer wall 24 of the housing 22 and the screen 32 covers the sound opening 28. The screen 32 is comprised of an air permeable material to pass audible sounds through the screen 32.

A monitor control circuit 34 is integrated into the housing 22 and the monitor control circuit 34 receives an alert input. The microphone 20 is electrically coupled to the monitor control circuit 34 and the monitor control circuit 34 receives the alert input when the microphone 20 detects audible sounds that have an intensity which is greater than a predetermined trigger intensity. A transmitter 36 is integrated into the housing 22 and the transmitter 36 is electrically coupled to the monitor control circuit 34. The transmitter 36 broadcasts the alert signal when the monitor control circuit 34 receives the alert input and the alert signal comprising the audible sounds captured by the microphone 20. Furthermore, the transmitter 36 may comprise a radio frequency transmitter 36 or the like and the transmitter 36 may employ Bluetooth communication protocols.

A monitor power supply 38 is integrated into the baby monitor 18 and the monitor power supply 38 is electrically coupled to the monitor control circuit 34. The monitor power supply 38 comprises a rechargeable battery 40 that is integrated into the housing 22 and the rechargeable battery 40 is electrically coupled to the monitor control circuit 34. The monitor power supply 38 includes a charge port 42 that is recessed into the housing 22. The charge port 42 is electrically coupled to the rechargeable battery 40 for charging the rechargeable battery 40.

A charge cord 44 is included that has a first plug 46 which is electrically coupled to a first end 47 of the charge cord 44 and the first plug 46 is electrically matable to the charge port 42. The charge cord 44 has a second plug 48 that is electrically coupled to a second end 49 of the charge cord 44 and the second plug 48 can be electrically coupled to a power source 50 comprising a female electrical outlet. The charge port 42 may be a universal serial bus port or other type of charge port 42 and the first plug 46 may be a universal serial bus plug or the like. Additionally, the second plug 48 may be a male electrical plug. A power button 51 is movably integrated into the housing 22 and the power button 51 is electrically coupled to the monitor control circuit 34 for turning the monitor control circuit 34 on and off.

A pair of ear buds 52 is provided and each of the ear buds 52 has a speaker 54 that is integrated into the ear buds 52. Each of the ear buds 52 can be inserted into a respective one of a user's ears 56 for emitting audible sounds into the user's ears 56. Additionally, each of the ear buds 52 is in wireless communication with the personal electronic device 12 such that the ear buds 52 receives an audio signal from the personal electronic device 12 to stream music for the user to listen to. The user may be a parent of the baby or an authorized caregiver of the baby.

Each of the ear buds 52 is in wireless communication with the baby monitor 18. Furthermore, each of the ear buds 52 reduces a volume of the audio signal when the ear buds 52 receives the alert signal from the baby monitor 18 to alert the user that the baby is crying. Each of the ear buds 52 comprises an ear bud control circuit 58 that is integrated into the ear bud 52. The ear bud control circuit 58 receives an alarm input and the speaker 54 in each ear bud 52 is electrically coupled to the ear bud control circuit 58. Additionally, the speaker 54 in each of the ear buds 52 may comprise an electronic speaker or the like.

An ear bud transceiver 60 is integrated into each ear bud and the ear bud transceiver 60 is electrically coupled to the ear bud control circuit 58. The ear bud transceiver 60 is in wireless communication with the device transceiver 14 for receiving the media signal from the device transceiver 14. Furthermore, the ear bud transceiver 60 is in wireless communication with the transmitter 36 in the baby monitor 18. The ear bud control circuit 58 receives the alarm input when the ear bud transceiver 60 receives the alert signal from the transmitter 36 in the baby monitor 18.

The ear bud transceiver 60 reduces an intensity of the media signal from the device transceiver 14 to a minimum intensity when the ear bud control circuit 58 receives the alarm input. The ear bud transceiver 60 increases an intensity of the audible sounds in the alert signal from the transmitter 36 in the baby monitor 18 when the ear bud control circuit 58 receives the alarm input. In this way the ear bud transceiver 60 ensured the user hears the baby crying when the user is streaming audio from the personal electronic device 12. The ear bud transceiver 60 may comprise a radio frequency transceiver or the like and the ear bud transceiver 60 may employ Bluetooth communication protocols.

An ear bud power supply 62 is integrated into each ear bud 52 and the ear bud power supply 62 is electrically coupled to the ear bud control circuit 58. The ear bud power supply 62 comprises a rechargeable battery. A docking port 64 is included and the docking port 64 has a pair of charging wells 66 that is each recessed into the docking port 64. Each of the charging wells 66 insertably receives a respective one of the ear buds 52. The docking port 64 includes an induction charger 68 that is integrated into the docking port 64. The induction charger 68 broadcasts a charging signal to the ear bud power supply 62 in each of the ear buds 52 for charging the ear bud power supply 62 in each of the ear buds 52 when the ear buds 52 are positioned in the charging wells 66.

In use, the baby monitor 18 is positioned in the room in which the baby is sleeping and the ear buds 52 are synced with the baby monitor 18 and the personal electronic device 12. In this way the ear buds 52 can stream music or other audio into the user's ears 56. The volume of the audio received from the personal electronic device 12 is reduced such that the volume of the baby crying is loud enough in the ear buds 52 for the user to hear. In this way the user can hear when the baby is crying while the user is listening to music.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A wireless baby monitor assembly for facilitating a parent to monitor a sleeping baby while also streaming music, said assembly comprising:

a personal electronic device, said personal electronic device including a device transceiver being in wireless communication with an extrinsic communication network wherein said personal electronic device is configured to receive a media signal from the extrinsic communication network;

a baby monitor being positionable in a room where a baby is sleeping, said baby monitor having a microphone being integrated into said baby monitor wherein said microphone is configured to capture the sounds of the baby crying, said baby monitor broadcasting an alert signal when said microphone captures the sounds of the baby crying; and a pair of ear buds, each of said ear buds having a speaker being integrated into said ear buds wherein each of said ear buds is configured to be inserted into a respective one of a user's ears for emitting audible sounds into the user's ears, each of said ear buds being in wireless communication with said personal electronic device such that said ear buds receives an audio signal from said personal electronic device wherein each of said ear buds is configured to stream music for the user to listen to, each of said ear buds being in wireless communication with said baby monitor, each of said ear buds reducing a volume of said audio signal when said ear buds receives said alert signal from said baby monitor wherein said ear buds are configured to alert the user that the baby is crying.

2. The assembly according to claim 1, wherein said baby monitor comprises:

a housing having an outer wall, said outer wall having a first lateral side, said first lateral side having a sound opening extending into an interior of said housing wherein said sound opening is configured to pass audible sounds into said housing, said microphone being integrated into said housing, said microphone being aligned with said sound opening, said outer wall having indicia being printed thereon, said indicia comprising the letters "BNB";

a screen being coupled to said outer wall of said housing, said screen covering said sound opening, said screen being comprised of an air permeable material wherein said screen is configured to pass audible sounds through said screen;

a monitor control circuit being integrated into said housing, said monitor control circuit receiving an alert input, said microphone being electrically coupled to said monitor control circuit, said monitor control circuit receiving said alert input when said microphone detects audible sounds that have an intensity that is greater than a pre-determined trigger intensity; and a transmitter being integrated into said housing, said transmitter being electrically coupled to said monitor control circuit, said transmitter broadcasting said alert signal when said monitor control circuit receives said alert input, said alert signal comprising the audible sounds captured by said microphone.

3. The assembly according to claim 2, wherein said baby monitor comprises:

a monitor power supply being integrated into said baby monitor, said monitor power supply being electrically coupled to said monitor control circuit, said monitor power supply comprising:

a rechargeable battery being integrated into said housing, said rechargeable battery being electrically coupled to said monitor control circuit;

a charge port being recessed into said housing, said charge port being electrically coupled to said rechargeable battery for charging said rechargeable battery;

a charge cord having a first plug being electrically coupled to a first end of said charge cord, said first plug being electrically matable to said charge port, said charge cord having a second plug being electrically coupled to a second end of said charge cord wherein said second plug is configured to be electrically coupled to a power source comprising a female electrical outlet; and a power button being movably integrated into said housing, said power button being electrically coupled to said monitor control circuit for turning said monitor control circuit on and off.

4. The assembly according to claim 2, wherein each of said ear buds comprises:

an ear bud control circuit being integrated into said ear bud, said ear bud control circuit receiving an alarm input, said speaker in said ear bud being electrically coupled to said ear bud control circuit; and a ear bud transceiver being integrated into said ear bud, said ear bud transceiver being electrically coupled to said ear bud control circuit, said ear bud transceiver being in wireless communication with said device transceiver for receiving the media signal from said device transceiver, said ear bud transceiver being in wireless communication with said transmitter in said baby monitor.

5. The assembly according to claim 4, wherein said ear bud control circuit receives said alarm input when said ear bud transceiver receives said alert signal from said transmitter in said baby monitor, said ear bud transceiver reducing an intensity of the media signal from said device transceiver to a minimum intensity when said ear bud control circuit receives said alarm input, said ear bud transceiver increasing an intensity of the audible sounds in said alert signal from said transmitter in said baby monitor wherein said ear bud transceiver is configured to ensure the user hears the baby crying when the user is streaming audio from said personal electronic device.

6. The assembly according to claim 5, further comprising:

an ear bud power supply being integrated into said ear bud, said ear bud power supply being electrically coupled to said ear bud control circuit, said ear bud power supply comprising a rechargeable battery; and a docking port having a pair of charging wells each being recessed into said docking port, each of said charging wells insertably receiving a respective one of said ear buds, said docking port including an induction charger being integrated into said docking port, said induction charger broadcasting a charging signal to said ear bud power supply in each of said ear buds for charging said ear bud power supply in each of said ear buds when said ear buds are positioned in said charging wells.

7. A wireless baby monitor assembly for facilitating a parent to monitor a sleeping baby while also streaming music, said assembly comprising:

a personal electronic device, said personal electronic device including a device transceiver being in wireless communication with an extrinsic communication network wherein said personal electronic device is configured to receive a media signal from the extrinsic communication network;

a baby monitor being positionable in a room where a baby is sleeping, said baby monitor having a microphone being integrated into said baby monitor wherein said microphone is configured to capture the sounds of the baby crying, said baby monitor broadcasting an alert signal when said microphone captures the sounds of the baby crying, said baby monitor comprising:

a housing having an outer wall, said outer wall having a first lateral side, said first lateral side having a sound opening extending into an interior of said housing wherein said sound opening is configured to pass audible sounds into said housing, said microphone being integrated into said housing, said microphone being aligned with said sound opening, said outer wall having indicia being printed thereon, said indicia comprising the letters "BNB";

a screen being coupled to said outer wall of said housing, said screen covering said sound opening, said screen being comprised of an air permeable material wherein said screen is configured to pass audible sounds through said screen;

a monitor control circuit being integrated into said housing, said monitor control circuit receiving an alert input, said microphone being electrically coupled to said monitor control circuit, said monitor control circuit receiving said alert input when said microphone detects audible sounds that have an intensity that is greater than a pre-determined trigger intensity;

a transmitter being integrated into said housing, said transmitter being electrically coupled to said monitor control circuit, said transmitter broadcasting said alert signal when said monitor control circuit receives said alert input, said alert signal comprising the audible sounds captured by said microphone; and a monitor power supply being integrated into said baby monitor, said monitor power supply being electrically coupled to said monitor control circuit, said monitor power supply comprising:

a rechargeable battery being integrated into said housing, said rechargeable battery being electrically coupled to said monitor control circuit;

a charge port being recessed into said housing, said charge port being electrically coupled to said rechargeable battery for charging said rechargeable battery;

a charge cord having a first plug being electrically coupled to a first end of said charge cord, said first plug being electrically matable to said charge port, said charge cord having a second plug being electrically coupled to a second end of said charge cord wherein said second plug is configured to be electrically coupled to a power source comprising a female electrical outlet; and a power button being movably integrated into said housing, said power button being electrically coupled to said monitor control circuit for turning said monitor control circuit on and off;

a pair of ear buds, each of said ear buds having a speaker being integrated into said ear buds wherein each of said ear buds is configured to be inserted into a respective one of a user's ears for emitting audible sounds into the user's ears, each of said ear buds being in wireless communication with said personal electronic device such that said ear buds receives an audio signal from said personal electronic device wherein each of said ear buds is configured to stream music for the user to listen to, each of said ear buds being in wireless communication with said baby monitor, each of said ear buds reducing a volume of said audio signal when said ear buds receives said alert signal from said baby monitor wherein said ear buds are configured to alert the user that the baby is crying, each of said ear buds comprising:

an ear bud control circuit being integrated into said ear bud, said ear bud control circuit receiving an alarm input, said speaker in said ear bud being electrically coupled to said ear bud control circuit;

a ear bud transceiver being integrated into said ear bud, said ear bud transceiver being electrically coupled to said ear bud control circuit, said ear bud transceiver being in wireless communication with said device transceiver for receiving the media signal from said device transceiver, said ear bud transceiver being in wireless communication with said transmitter in said baby monitor, said ear bud control circuit receiving said alarm input when said ear bud transceiver receives said alert signal from said transmitter in said baby monitor, said ear bud transceiver reducing an intensity of the media signal from said device transceiver to a minimum intensity when said ear bud control circuit receives said alarm input, said ear bud transceiver increasing an intensity of the audible sounds in said alert signal from said transmitter in said baby monitor wherein said ear bud transceiver is configured to ensure the user hears the baby crying when the user is streaming audio from said personal electronic device; and an ear bud power supply being integrated into said ear bud, said ear bud power supply being electrically coupled to said ear bud control circuit, said ear bud power supply comprising a rechargeable battery; and a docking port having a pair of charging wells each being recessed into said docking port, each of said charging wells insertably receiving a respective one of said ear buds, said docking port including an induction charger being integrated into said docking port, said induction charger broadcasting a charging signal to said ear bud power supply in each of said ear buds for charging said ear bud power supply in each of said ear buds when said ear buds are positioned in said charging wells.

* * * * *